United States Patent [19]

Farkas

[11] 4,200,973

[45] May 6, 1980

[54] METHOD OF MAKING SELF-TEMPERATURE REGULATING ELECTRICAL HEATING CABLE

[75] Inventor: Richard W. Farkas, Stow, Ohio

[73] Assignee: Samuel Moore and Company, Aurora, Ohio

[21] Appl. No.: 932,552

[22] Filed: Aug. 10, 1978

[51] Int. Cl.[2] ..... H05B 3/10

[52] U.S. Cl. ..... 29/611; 219/549; 252/511; 338/22 SD; 338/214

[58] Field of Search ..... 29/611, 612, 613, 610 R; 338/22 R, 22 SD, 210, 214, 229; 252/511; 219/549, 528, 530

[56] References Cited

U.S. PATENT DOCUMENTS

| | | | |
|---|---|---|---|
| 2,750,482 | 6/1956 | Peterson | 338/26 |
| 2,905,919 | 9/1956 | Lorch | 338/214 |
| 3,413,442 | 11/1968 | Buiting | 219/510 |
| 3,793,716 | 2/1974 | Smith | 29/611 |
| 3,861,029 | 1/1975 | Smith | 29/610 R |
| 3,914,363 | 10/1975 | Bedard | 29/611 |

*Primary Examiner*—Francis S. Husar
*Assistant Examiner*—Gene P. Crosby
*Attorney, Agent, or Firm*—Stevens, Davis, Miller & Mosher

[57] ABSTRACT

Disclosed are improved melt processable, self-temperature regulating, irradiation cross-linkable, electrically semi-conductive polymeric compositions which in conjunction with annealing at a temperature at or above their melt point temperatures subsequent to their having been radiation cross-linked provide for improved self-temperature regulating electrical heating devices including flexible electrical heating cables. Heating cables made in accordance with the invention comprise two or more elongate substantially parallel spaced-apart electrical conductors that are electrically inter-connected by means of extruded forms of the compositions which have been annealed at a temperature at or above their melt point temperatures prior and subsequent to their having been cross-linked by irradiation. The compositions of the invention have an amount of electrically conductive particles, such as carbon black, dispersed therein, that is controlled within the range of 17% to 25% by weight to the total weight of the compositions. The semi-conductive compositions are characterized by exhibiting a positive temperature coefficient of electrical resistance and by having sufficient crystallinity in their polymeric portion to provide attractive self-temperature heat regulating characteristics in conjunction with a lessening of criticality in their annealing requirements from that heretofore associated with the process of making electrical heating cables utilizing electrically semi-conductive polymeric materials.

6 Claims, 5 Drawing Figures

Fig. 1
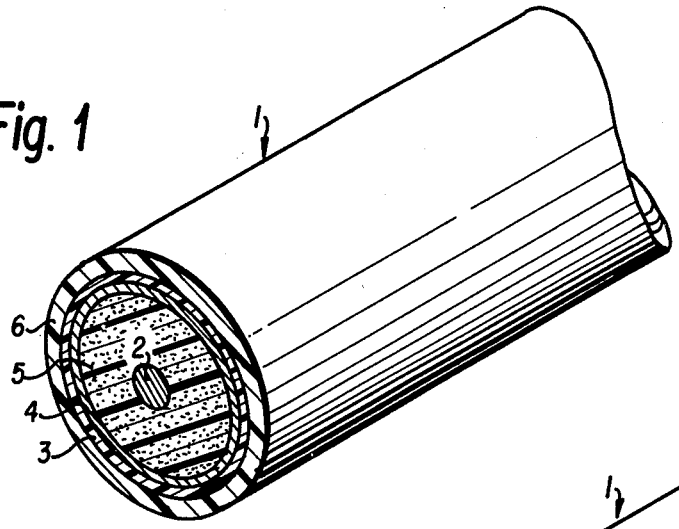
Fig. 2
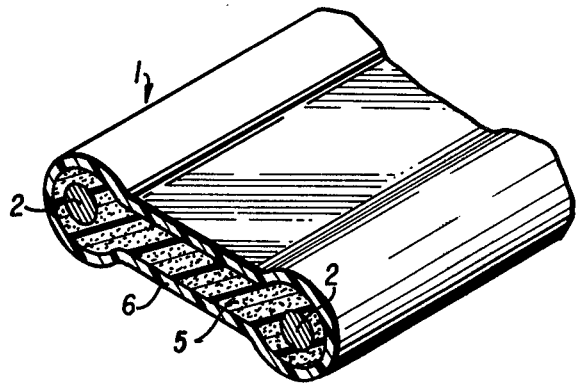
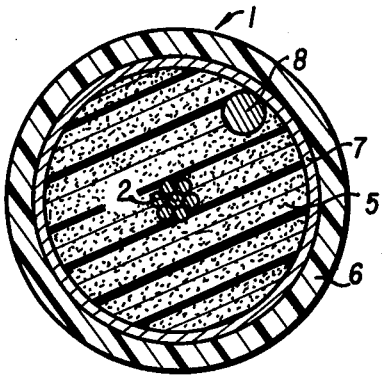
Fig. 3
Fig. 4
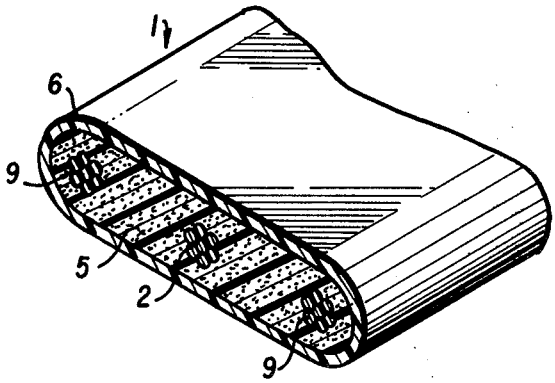
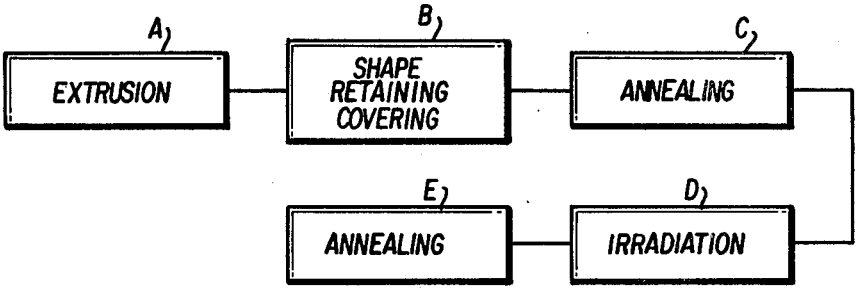
Fig. 5

METHOD OF MAKING SELF-TEMPERATURE REGULATING ELECTRICAL HEATING CABLE

This invention relates generally to improved melt processable, self-temperature regulating, irradiation cross-linked electrically semi-conductive polymeric compositions having a positive temperature coefficient of electrical resistance and their use in flexible electrical heating devices and in particular to their use in flexible electrical heating cables having extruded, irradiation cross-linked, forms of the polymeric compositions and more particularly to improved melt processable self-temperature regulating irradiation cross-linked semi-conductive polymeric compositions which contain an amount of electrically conductive particles, such as carbon black, dispersed therein that is controlled within the range of 17% to 25% by weight to the total weight of the semi-conductive composition and which have been annealed, at a temperature at or above their melt point temperatures subsequent to their having been radiation cross-linked in conjunction with their use in making electrical heating devices and the method of making flexible electrical heating cables using extruded forms of the compositions whereby the compositions are annealed at a temperature at or above their melt point temperatures prior and subsequent to their having been cross-linked by radiation.

BACKGROUND OF THE INVENTION

Self-regulating heaters utilizing electrically semi-conductive compositions having a positive temperature coefficient of electrical resistance and containing restrictively prescribed amounts of electrically conductive particles, such as carbon black, are well known in the prior art.

Generally, a material which exhibits a positive temperature coefficient of electrical resistance is a material whose electrical resistance increases as a result of an increase in its temperature. It is believed by many that polymeric compositions containing dispersed electrically conductive particles, such as carbon black, exhibit a positive temperature coefficient of electrical resistance as a result of the polymeric matrix expanding at a rate greater than that of the electrically conductive particles when subjected to an increase in temperature. It has been theorized that such polymeric matrix expansion tends to increase, or otherwise alter, the spacial relationship between the electrically conductive particles in such a manner as to result in an increase in the electrical resistance of the polymeric composition. An increase in the electrical resistance of the polymeric composition would correspondingly reduce the amount of electrical current derived from a fixed electrical potential placed across the composition and reduce the amount of heat generated by the electrical current according to the established relationship of heat equals $I^2R$.

It is the theory of others that the amount of crystallinity present in a polymeric composition containing electrically conductive particles is an important factor in providing a useful positive temperature coefficient of electrical resistance. According to this train of thought, an increase in electrical resistance may arise as a result of the reorientation of the crystalline-amorphic boundaries when the polymeric composition's temperature is caused to increase and which, aside from whether or not the composition expands during its increase in temperature, tends to electrically insulate the conductive particles (or groups of the electrically conductive particles) more effectively from each other and thereby contributes to an increase in the all-over electrical resistance of the composition.

Previous studies of polymeric compositions containing varying amounts of dispersed electrically conductive carbon blacks have shown certain characteristics as to the magnitude of increase of electrical resistance per thermal unit of temperature increase. Such studies have also resulted in derived terminology that is useful in describing certain relationships. Generally, the type and make-up of the polymeric composition; the nature, physical size and amount of electrically conductive particles; and the method by which they are dispersed in the polymeric matrix determines the value of derived terms such as, for example, $R_{25}$ (electrical resistance at 25° C.); $T_c$ (controlling temperature about which the electrical resistance increases or decreases in response to an electrical current having a fixed potential; $R_p$ (peak electrical resistance above which the electrical resistance of the semi-conductive composition begins to reverse itself and decrease rapidly in response to an increase in temperature in association with the melt phase of the polymeric composition; and $R_p/R_{25}$ (the ratio of the above described electrical resistances generally depicting the range of resistance between the given two temperature points.

Until the time of the present invention, it was thought that in order to provide a useful electrically semi-conductive heating device the amount of electrically conductive carbon black particles dispersed in the polymeric composition must be either 15% or less or 25% or more, by weight, of the total weight of the composition. An example of such compositions can be found in Kohler's U.S. Pat. No. 3,243,573 wherein the electrically semi-conductive compositions are described as containing 25 to 75 percent by weight carbon black as a result of in-situ polymerization. Although such compositions may be useful for some heating purposes, it has been found that polymeric compositions containing more than 25% by weight of carbon black generally possess poor cold temperature properties; exhibit inferior elongation characteristics; and generally do not possess good electrical current regulating characteristics in response to changes in temperature. As noted above, it has also been proposed that electrically semi-conductive compositions must not have more than 15% by weight of carbon black in order to provide a useful self-regulating heating device. Such teaching can be found, for example, in U.S. Pat. No. 3,793,716 in which a process is described for making a self-regulating heating element utilizing a composition having less than 15% by weight of carbon black incorporated therein. This contention is also maintained in U.S. Pat. No. 3,861,029 wherein a polymeric material containing not more than about 15% by weight of carbon black is subjected to a prolonged annealing procedure to reduce its electrical volume resistivity at room temperature to from about 5 to about 100,000 ohm-cm.

A further extension of this belief can be found in U.S. Pat. No. 3,914,363 wherein a shape retaining thermoplastic jacket is disposed about self-regulating conductive articles utilizing crystalline polymeric compositions containing not more than about 15% by weight of conductive carbon black and the combination thereof is subjected to an annealing procedure whereby the room temperature electrical volume resistivity of the polymeric composition is reduced to within the range of from about 5 to about 100,000 ohm-cm. This contention is also reiterated in U.S. Pat. No. 3,823,216 wherein a cyclic annealing process is disclosed and claimed for reducing the electrical volume resistivity to a value within the range of from about 5 to about 100,000 ohm-cm at 70° F. for compositions disclosed therein which are used in self-temperature regulating articles and which contain carbon lack dispersed therein in an amount not greater than about 15% by weight to the total weight of the composition.

Electrically conductive compositions can additionally be found, for example, in U.S. Pat. No. 2,750,482 in which is disclosed an amorphous polyisobutylene material containing conducting particles for use in high temperature alarms and in U.S. Pat No. 2,905,919 in which an electrical heating cable is described as containing a semi-conductive body of pulverulent inorganic material. A further example of an electrically semi-conductive composition can be found in U.S. Pat. No. 3,179,544 in which an electrically conductive article is produced by depositing an electrically conductive composition comprising an aqueous dispersion of graphite particles upon an insulating base. Still further examples of electrically semi-conductive compositions can be found in U.S. Pat. No. 2,803,566 in which an article is disclosed having a coating thereupon of a mixture of colloidal silica, substantially free of alkalai and in U.S. Pat. No. 3,413,442 in which a semi-conductive material is disclosed having a steep slooped positive temperature coefficient for use in electrical heating devices in the form of an open ended container.

SUMMARY OF THE INVENTION

It is an object of this invention to provide improved melt processable, self-temperature regulating, irradiation cross-linkable, electrically semi-conductive polymeric compositions adapted for use in electrical heating devices wherein the compositions contain an amount of electrically conductive particles, such as carbon black, dispersed therein that is controlled within the range of 17% to 25% by weight to the total weight of the composition and exhibit a positive coefficient of electrical resistance and which in conjunction with annealing at a temperature at or above their melt point temperatures subsequent to their having been radiation cross-linked provide for improved uniformity and stability in their self-temperature regulating electrical heating characteristics. It is yet another object of this invention to provide improved electrical heating devices utilizing two or more spaced apart electrical conductors that are electrically interconnected by means of electrically semi-conductive polymeric compositions made and processed in accordance with the present invention. It is a further object of this invention to provide improved, flexible, self-temperature regulating electrical heating cables comprising two or more elongate substantially parallel spaced-apart electrical conductors electrically interconnected by means of extruded forms of electrically semi-conductive compositions made and processed in accordance with the present invention. It is yet a further object of this invention to provide a method of manufacturing improved, flexible, self-temperature regulating electrical heating cables utilizing extruded forms of electrically semi-conductive compositions made and processed in accordance with the present invention.

BRIEF DESCRIPTION OF THE DRAWINGS

Other objects will become apparent from the following description with reference to the accompanying drawing in which:

FIG. 1 is a fragmented perspective view showing an embodiment of the invention having a generally circular transverse cross-section and having a metallic coated film as one of the conductors;

FIG. 2 is a fragmented perspective view showing an embodiment of the invention having a bar-bell type transverse cross-section and having two elongate substantially parallel spaced-apart electrical conductors of the same general configuration;

FIG. 3 is a transverse cross-section of an embodiment of the invention wherein the outer electrical conductor is a metallic film and an additional electrical drain wire is incorporated between the film and the electrically semi-conductive composition;

FIG. 4 is a fragmented perspective view showing an embodiment of the invention having more than two electrical conductors; and FIG. 5 is a block diagram showing the method by which improved uniformity and heat stability and self-temperature regulating characteristics are achieved in electrical heating cables utilizing extruded forms of electrical semi-conductive compositions made in accordance with the invention.

DESCRIPTION OF SOME OF THE PREFERRED EMBODIMENTS

FIG. 1 shows an embodiment of the invention wherein generally tubular shaped flexible heating cable 1 has a generally circular transverse cross-section having longitudinally extended electrical conductor 2 disposed along the central longitudinal axis thereof. Electrical conductor 4, in the form of a metallic layer, surrounds conductor 2 and is substantially coaxial therewith and radially spaced apart therefrom. Barrier layer 3 surrounds and encloses conductors 2 and 4. Extruded and irradiation cross-linked electrically semi-conductive composition 5 made and processed in accordance with the invention is disposed intermediate conductor 2 and conductor 4 so as to provide an electrical interconnection therebetween. Outer protective jacket 6 is disposed in encompassing relationship about layer 3 in order to provide an electrically insulative protective outer covering. In the embodiment shown in FIG. 1, conductor 2 is in the form of a metallic wire. Although conductor 2 may be made from nickel-chromium alloys commonly known as, Nichrome, it is preferred that conductor 2 be made from suitable alloys of copper or aluminum having low electrical resistance. Conductor 2 may be made from uncoated or conductively coated solid or stranded wire and is preferably sized from about 10 AWG to about 22 AWG and more preferrably from about 14 AWG to about 18 AWG. Although it is preferred that conductor 2 be in the form of a wire, it may have any cross-sectional shape suitable for the purpose intended for a particular heating cable made in accordance with the invention. Although it is preferred that conductor 2 be made from a metallic material, it may be made from a non-metallic material or from combinations of metallic and non-metallic material provided its electrical resistance is sufficiently lower than that of composition 5 to provide effective electrical current carrying capacity along the axial length of cable 1 necessary for the operation of heating cables made in accordance with the invention. Electrically conductive layer 4 shown in FIG. 1 surrounds and is spaced radially apart from conductor 2 to provide a second electrical current carrying conductor required for operation of cable 1. Although conductor 4 (as in the case of conductor 2) may be made from an electrically conductive non-metallic material or combinations of non-metallic and metallic materials, it is preferred that conductor 4 be made from a metallic material such as suitable alloys of copper or aluminum. Although conductor 4 is shown in FIG. 1 as having a continuous transverse cross-section, it can readily be seen that conductor 4 may be in the form of a plurality of separate electrical conductors such as, for example, braided or spirally wound wire or in the form of a longitudinally folded or spirally wound tape. In the example shown in FIG. 1, conductor 4 is surrounded by layer 3. Although layer 3 is not essential to the construction, its incorporation into cable 1 is preferred so as to provide improved resistance to penetration of moisture and other fluids and vapors from outside of cable 1. Conductor 4 and layer 3 may be bonded together. Conductor 4 and layer 3 may comprise a combination wherein layer 3 is a polymeric film such as, for example, poly(alkylene)terrephthalate and conductor 4 is an electrically low resistance coating thereupon such as copper or aluminum metal. A preferred combination of conductor 4 and layer 3 is where conductor 4 is in the form of an aluminum or copper coating disposed upon a film form of layer 3 that is made from poly(ethylene)terrephthalate such as "Mylar" sold by E. I. du Pont de Nemours Company. Typically a "Mylar" film layer 3 having a ½ mil copper coating as conductor 4 may be used to advantage. As described above, it is preferred, but not essential, that conductor 4 be in the form of a coating on layer 3. Conductor 4 may be in the form of a tape with or without the presence in the construction of a layer 3 and may be longitudinally folded, spirally wound or otherwise disposed in a spaced-apart surrounding relationship to conductor 2.

Outer protective jacket 6, shown in FIG. 1, is disposed in encompassing relationship about layer 3 to provide protection and electrical insulation. Although jacket 6 may be made from any suitable flexible material possessing the electrically insulative and protective properties required, it is preferred that jacket 6 be made from an extrudable polymeric material such as, for example, nylon, polyurethane, polyvinyl chloride, rubber, rubber-like elastomers, and the like possessing such properties. The selection of a material for use in jacket 6 is typically based upon combining toughness, weatherability, chemical and heat resistance and electrical insulating characteristics combined with suitable flexibility characteristics. Jacket 6 is typically in the order of 15 to 60 mils in thickness and may be made from crystalline, semi-crystalline, amorphous or elastomeric materials which may, if desired, be cross-linkable by means of chemical vulcanization or irradiation. Since part of the process of making electrical heating devices under this invention requires that the compositions of the invention be annealed at a temperature at or above their melt point temperatures subsequent to their having been melt-processed and cross-linked by irradiation, it is required, in order to retain the shape thereof, that covering materials present during the annealing process such as jacket 6 or that covering which may be temporarily used to retain the processed shape, have a melt point temperature higher than the temperature used to anneal the particular composition made in accordance with this invention. Although it is preferred that jacket 6 be extruded about layer 3, it can be readily seen that jacket 6 may also be in the form of a winding, such as a tape, which is either spirally wound or longitudinally folded about layer 3 and may be suitably bonded thereto or, in the absence of layer 3, then either extruded, wound about, or longitudinally folded directly about conductor 4 and bonded thereto by suitable means, is such is desired, to provide the electrically insulative, protective and handling characteristics required. Although not shown in the preferred embodiments of the figures, flexible armour or other protective means may be disposed about the outer surface of jacket 6 to provide increased protection, if such is desired.

Semi-conductive composition 5 is disposed between conductor 2 and conductor 4 and provides an electrical interconnection therebetween. Composition 5 is an extruded, flexible, self-regulating irradiation cross-linked electrically semi-conductive material containing one or more polymeric components and has a positive temperature coefficient of electrical resistance provided by an amount of electrically conductive particles, such as carbon black, dispersed therein that is controlled within the range of from 17% to 25% by weight to the total weight of composition 5. Composition 5 has been annealed for a period of time suitable to promote the electrical characteristics desired thereof at a temperature that is at or above its melt point temperature prior to and subsequent to its having been radiation cross-linked and possesses sufficient crystallinity to provide the self-temperature regulating characteristics desired.

FIG. 2 illustrates an embodiment of heating cable 1 made in accordance with the invention wherein cable 1 has a generally bar-bell transverse cross-section. Shown in FIG. 2 are a pair of elongate substantially parallel electrical conductors 2 in the form of solid wires that are spaced apart along the longitudinal length of cable 1 and electrically interconnected by means of an extruded and irradiation cross-linked composition 5 made and processed in accordance with the invention. As in all embodiments of extruded forms of composition 5, made and processed in accordance with the invention, composition 5 has been annealed at a temperature at or above its melt point temperature prior and subsequent to its having been cross-linked by means of radiation. Protective jacket 6 is disposed in encompassing relationship about conductors 2 and composition 5 and may comprise materials and be formed by methods hereinbefore described.

As in all embodiments of the invention where jacket 6 is in direct contact with composition 5, it may be bonded to composition 5, if such is desired, and there may be additional bonded or unbonded layers about the outer surface of jacket 6 such as, for example, a protective flexible armour. There may also be a barrier layer such as, for example, "Mylar" film and the like, as hereinbefore described, disposed intermediate jacket 6 and composition 5 and which may or may not be bonded to composition 5 and/or jacket 6.

FIG. 3 illustrates an embodiment similar to that shown in FIG. 1. Shown in FIG. 3 is generally tubular shaped heating cable 1 having a generally circular transverse cross-section having longitudinally extending electrical conductor 2, in the form of a stranded wire, located generally along the central longitudinal axis thereof. Electrical conductor 8 is substantially parallel to and spaced radially apart from conductor 2 along the longitudinal length of cable 1 and is in electrical contact with electrical conductor 7. Electrical conductor 7 in FIG. 1 is a tubular spaced metallic film which may be disposed coaxially about conductors 6 and 8 by means of longitudinally folding or spirally wrapping a flexible tape form of conductor 7. Conductor 8 is in the form of a wire in the embodiment shown in FIG. 3 and is in electrical contact with the inner surface of conductor 7 to act as a drain wire for assisting conductor 7 in the transfer of electrical current along the longitudinal length of cable 1. Conductor 2 and the combination of conductors 7 and 8 are electrically interconnected by means of extruded, radiation cross-linked, electrically semi-conductive composition 5, made and processed in accordance with the invention, disposed between conductor 2 and the combination of conductors 7 and 8. Protective jacket 6 is disposed in encompassing relationship about conductor 7 and may or may not be bonded thereto dependent upon the performance or handling characteristics desired. Jacket 6, as for all embodiments of the invention, may have additional bonded or unbonded layers disposed about its outer surface such as, for example, flexible armour where such is desired. Cable 1 of FIG. 3 may also have a barrier layer disposed between conductor 7 and jacket 6 such as, for example, a "Mylar" film for improved resistance against fluid or water vapor penetration into cable 1 as herein before described. Conductor 7 may comprise a conductive coating upon a flexible polymeric film, as earlier described, such as "Mylar" wherein the conductive coating is in direct electrical contact with conductor 8 and the polymeric film portion is in contact with the inner surface of jacket 6. As in all embodiments of the invention, the various layers chosen may or may not be bonded together as desired so long as such bonding does not interfere with the ability of composition 5 of the invention to electrically inter-connect the two or more spaced-apart electrical conductors forming a part of cable 1.

FIG. 4 illustrates yet another embodiment of the invention wherein a tape form of cable 1 has more than two elongate substantially parallel electrical conductors spaced apart along the longitudinal length of cable 1. Such an example is for illustrative purposes only and is included merely to show that electrical cables made in accordance with the present invention are not limited to having only two spaced-apart electrical conductors. Cable 1 of FIG. 4 has a longitudinally extending conductor 2 in the form of a stranded wire generally centrally located along the longitudinal axis of cable 1 and is electrically inter-connected by means of extruded, radiation cross-linked, composition 5 made and processed in accordance with the invention, disposed between itself and two diametrically apposed substantially parallel electrical conductors 9 spaced-apart therefrom along the longitudinal axis of cable 1. Although conductors 2 and 9 are shown in the form of a stranded wire, it is to be understood, as earlier described, that electrical conductors used in heating devices utilizing compositions made and processed in accordance with the invention may be of any form suitable for the characteristics desired.

Where in previous examples, a suitably selected electrical potential (voltage) is placed across the spaced-apart conductors to derive the electrical current which passes through composition 5 from one conductor to the other conductor to create the heating characteristics desired, so it is in the case where more than two conductors are utilized in heating cables made in accordance with the present invention. Although it is preferred to impose a suitably derived and controlled alternating electrical potential across the spaced apart electrical conductors utilized in heating devices of the invention, a controlled direct electrical potential can be used where desired. Generally, in embodiments of heating cables of the invention having a centrally located conductor such as, for example, as shown in FIGS. 1 and 3, the central conductor is generally preferred as the "hot" line (high potential side) and the conductors spaced apart therefrom towards the protective jacket are preferred as the "ground" (low potential side). In an embodiment such as shown in FIG. 3, either conductor may be used as the ground or low potential line. An embodiment, such as shown in FIG. 4, can be used to advantage that centrally located conductor 2 can be used either as the high or low potential line whilst the conductors 9 spaced apart therefrom can both be used as a carrier of electrical potential of higher or lower magnitude than that of central conductor 2. For example, when central conductor 2 is used as the "ground" or low potential line, both the electrical conductors 9 spaced therefrom can be used as the "hot" or high potential line or vice versa. A construction, such as shown in FIG. 4, permits wider configurations of heating cables to be made in accordance with the invention since the distance between conductors is an important factor in conjunction with the semi-conductive nature of the composition electrically inter-connecting the conductors whereby such distances can be reduced by the use of more than two conductors and thereby reduce the amount of electrical potential required to drive the desired electrical current through the semi-conductive composition to create the heating characteristics required. Cable 1 of FIG. 4 has flexible protective jacket 6 disposed about electrically semi-conductive composition 5 and conductors 2 to provide the protective and electrical insulating characteristics desired. As in all embodiments of the invention, jacket 6 may have additional bonded or unbonded barriers disposed between it and composition 5, as hereinbefore described, and may be surrounded by bonded or unbonded layers such as, for example, a flexible armour.

Although the electrically conducting particles used in compositions of the invention may be metallic in nature such as, for example, silver, aluminum, iron, or the like, it is preferred that carbon particles such as carbon black or graphite be used and more preferred that a highly electrically conductive furnace black be used such as, for example, Vulcan XC-72 sold by Cabot Corporation. Although the amount of electrically conductive particles present in the compositions of the invention is controlled within the range of 17% to 25% by weight to the total weight of the particular composition, it is preferred that the amount of conductive particles be from about 20% to about 22% by weight to the total weight of the particular composition.

Compositions of the invention may be made from polymeric, homopolymers or copolymers of crystalline materials such as, for example, polyethylene, polypropylene and blends thereof. Generally, the compositions of the invention contain one or more melt-processable crystalline and/or semi-crystalline polymeric materials which may be combined with suitably selected amorphous and/or elastomeric polymeric materials provided that the completed compositions of the invention made therefrom remains melt-processable. A composition made in accordance with the invention may, for example, contain a copolymer or blend of low density polyethylene and ethylene vinyl acetate as the crystalline melt-processable component thereof. Generally the type and crystalline aspects of a particular polymer or combination of polymers selected for use in making compositions of the invention determines the hereinbefore described controlling temperature "$T_c$" about which the composition will self-temperature regulate. Thus, for example, a composition of the invention based upon a particular low density polyethylene might be made to self-temperature regulate about 70° C. whereas a composition of the invention based upon a polypropylene might be made to self-temperature regulate about 90° C. Higher controlling temperature "$T_c$" may be provided by formulating compositions of the invention to include melt-processable fluorinated and/or fluorochlorinated materials such as, for example, polyvinylidene fluoride and copolymers thereof with tetrafluoroethylene, and the like. Generally, the one or more polymers chosen for use in making a particular composition of the invention are selected on the basis of their nature and crystalline contents in conjunction with the hereinbefore described electrically conductive particles and other additives (if such are desired) to provide a melt-processable composition that provides a controlling temperature "$T_c$" after being processed in accordance with the invention that is satisfactorily beneath the long-term heat exposure degradation level determined or known for the particular composition.

Compositions of the invention may contain other additives such as, for example, processing aids, fillers, anti-oxidants, heat stablizers, and the like, provided that the resultant composition remains melt-processable and radiation-cross-linkable while providing the physical, chemical, heat resistance and self-temperature regulating characteristics desired.

The flexibility of compositions made in accordance with the invention is accordingly dependent upon the crystallinity and nature of the polymers selected for their making in addition to the effects created by the incorporation of the controlled amount of electrically conductive particles of the invention and other additives which may be included as described above. Thus compositions made in accordance with the invention may range from relative rigid versions having melt processability characteristics more suitable for injection molding to more flexible versions having melt-processing characteristics more suitable to the process of extrusion such as, for example, for use in making the flexible heating cables of the invention. Generally, the method of melt-processing a particular composition made in accordance with the invention can be determined by means of experimentation and examination of the rheological aspects of the particular composition. Although electrical heating cables made from extruded forms of the compositions of the invention require annealing prior and subsequent to their cross-linking by radiation, compositions melt processed by other methods to make electrical heating devices of the invention may not require annealing prior to their radiation cross-linking.

It is required that compositions of the invention be cross-linked by radiation subsequent to their having been melt-processed into the form required for the particular self-temperature regulating device desired. In making electrical heating cables of the invention, it is preferred that the compositions of the invention be extruded since it provides economic savings and other advantages associated with the capability of producing long continuous lengths. Although any suitable means of radiation may be used to cross-link compositions of the invention, it is preferred that they are cross-linked by means of suitable exposure to high speed electrons such as, for example, as produced by a high energy electron Beam Generator. Other components used in electrical heating devices in combination with compositions of the invention (such as, for example, the outer protective jacket of flexible heating cables of the invention) may also be cross-linked by irradiation during the process of making the device if such is desired. The irradiation cross-linkability of compositions of the invention may be improved by the incorporation therein of radiation sensitizing materials such as, for example, m-phenylene dimaleimide sold under the name of "HVA-2" E. I. du Pont de Nemours and Company in the event it is determined that such is required.

It has been found that the incorporation of a controlled amount of electrically conductive particles, such as carbon black, into compositions of the invention and subsequently cross-linking them by radiation, after their having been melt-processed, in combination with the annealing thereof at a temperature at or above their melt point temperature subsequent to radiation cross-linking provides improved self-temperature regulating electrical heating devices that have been heretofore unavailable. It has been found that the incorporation of between 17% to 25%, by weight, of carbon black, such as Vulcan XC-72, into compositions of the invention results in an electrical resistance at 25° C. ($R_{25}$) which is low enough to permit effective heating whilst using an effective level of electrical current yet provides a controlling temperature ($T_c$) for keeping the heat generated sufficiently below the long-term maximum continuous use temperature associated with the composition in combination with an effective peak electrical resistance ($R_p$) to protect the composition from self-destructing.

An example of a flexible heating cable made in accordance with the invention and its comparison to heating cables containing less than 15% carbon black in conjunction with variations in annealing techniques is illustrated in the following table.

| | SAMPLE* | | | | |
|---|---|---|---|---|---|
| | A | B | C | D | E |
| Polymeric Component | All are low density Polyethylene | | | | |
| % Carbon Black (Vulcan XC-72) | 11 | 22 | 22 | 11 | 22 |
| Annealing Schedule*** | 1 | 2 | 3 | 4 | 5 |
| $R_{25}$ (ohm/ft.) | $3.2 \times 10^4$ | $5.4 \times 10^2$ | $3.9 \times 10^3$ | $1.1 \times 10^8$ | $5 \times 10^2$ |
| $R_p$ (ohm/ft.) | $4 \times 10^8$ | $1.1 \times 10^5$ | $3.9 \times 10^7$ | $1.8 \times 10^9$ | Not Tested |
| $R_p/R_{25}$ | 12,500 | 204 | 10,000 | 16 | Not Tested |
| Current Draw on | 4 | 230 | 23 | Not Tested | Not Tested |

-continued

| | SAMPLE* | | | | |
|---|---|---|---|---|---|
| | A | B | C | D | E |
| Energizing (mA)** | | | | | |
| $T_c$ (°C.)** | 22 | 66 | 31 | Not Tested | Not Tested |
| Controlling Current (mA)** | 3.5 | 42 | 13 | Not Tested | Not Tested |

*The compositions are blends of low density polyethylene and the indicated amount of carbon black without additional additives. The heating cables containing the compositions were made by extruding the compositions about a pair of spaced apart 18 AWG (19 Strand) tinned copper conductors such that the cables assumed a bar-bell transverse cross-sectional shape such as shown in FIG. 2. A shape-retaining jacket of polyurethane was extruded about the extruded composition and conductors to prevent deformation during the annealing process.
**Ambient Temperature 17° C.
***Annealing Schedule:
(1) 24 hr. at 150° C. without any cross-linking or annealing thereafter.
(2) Same as (1) above.
(3) 24 hr. at 150° C. prior and 1 hr. at 150° C. subsequent to cross-linking by electron irradiation.
(4) Same as (3) above.
(5) 24 hr. at 150° C. prior to cross-linking by electron radiation.

The above comparison illustrates that Sample "C" (made and processed in accordance with the invention) possesses an effectively low ($R_{25}$); an attractively high ($R_p$); and effective ($R_p/R_{25}$); and an attractive ($T_c$).

It has been found that compositions made and processed in accordance with the present invention exhibit improved long-term operating stability over that of Sample "A" at a ($T_c$) attractively below the long-term maximum use temperature established for the composition as a result of the controlled amount of carbon black of the invention. It has also been found that heating cables such as Sample "B" above which contain more than 15% carbon black and which have not been cross linked by radiation and subsequently annealed at a temperature at or above the melt point temperature of the respective compositions tend to either fail or exhibit erratic heating performance in actual use which is believed to be the result of their having an extremely low $R_{25}$; low $R_p/R_{25}$; and high $T_c$. It has been found that heating cables processed in accordance with Sample "B" may fail catastrophically after energization. It has also been found that compositions such as Sample "D" having less than 15% carbon black and processed in accordance with the invention tend to have a high $R_{25}$ causing them to perform relatively ineffectively as heaters.

Sample "E" above is the same as Sample "C" except it has not been annealed at a temperature at or above its melt point temperature after having been cross-linked by radiation. Sample "E" illustrates that by not annealing the composition after cross-linking the $R_{25}$ of the composition remains low in comparison to that shown for Sample "C" above. It has been determined that a low $R_{25}$ such as found in Sample "E" provides poor heat regulating characteristics.

FIG. 5 illustrates, by means of block diagrams, the basic steps of the preferred process by which flexible heating cables utilizing extruded compositions of the present invention can be made. Generally, the hereinbefore described polymeric components, conductive particles and additional additives, if any, of the present invention are uniformly mixed and blended by suitable means such as, for example, by use of a Brabender Batch type or Henschel continuous type mixer, extruder, and the like. Although it is preferred that the components be mixed and blended in conjunction with sufficient heat to promote uniform distribution of the conductive particles prior to the extrusion of the compositions, as shown in Step "A", into a flexible heating cable, the components, dependent on the particular composition, may be dry blended and extruded directly to electrically interconnect the one or more electrical conductors making up the particular heating cable provided that such blending disperses the conductive particles uniformily. Although the annealing step shown in Step "C" may not be required in certain melt-processing techniques other than extrusion, it has been found that, because of the disruptive effect of extrusion upon the electrical characteristics of the compositions of the invention, annealing is required prior to irradiation cross-linking in making electrical heating cables under the present invention in order to achieve the characteristics desired. Since the annealing Step "C" is at a temperature that is at or above the melt point temperature of the composition, it is required that a shape retaining covering be disposed thereabout as illustrated by Step "B" of FIG. 5. The shape retaining cover is required to have a melt point temperature that is higher than that of the annealing temperature in order to prevent or minimize deformation of the extruded composition. The covering, dependent upon the particular heating cable being made, may be temporary or permanent in nature. If it is permanent in nature such as, for example, an extruded jacket, barrier, or conductor, it must be penetrable by the radiation of Step "D" in order that the composition beneath the covering can be cross-linked and, dependent upon materials used; may themselves be cross-linked by radiation during the process of cross-linking the composition of the invention. If the covering is temporary and provides no other function other than shape retainment and is intended to be removed after annealing then it is required to have a melt point temperature higher than the annealing temperature and may or may not be penetrable by radiation depending upon whether it was removed after annealing Step "C" and before Step "D" or after annealing Step "E". The extruded form of the electrical cable having a shape retaining cover is annealed in Step "C" at a temperature that is at or above the melt point temperature of the composition for a period of time sufficient to effect the characteristics desired. Generally, annealing Step "C" is required in order to reduce the electrical resistance elevations resulting from the disruptive effects of extrusion. Although not shown in FIG. 5, it is to be understood that cooling the composition of the invention from a higher temperature to a lower temperature is included in the process of making heating devices such as heating cables under the invention. Although, it is within the scope of the invention that certain types of heating devices may be made under the invention in a continuous manner without substantial cooling excepting after its annealing after cross-linking by radiation, it is preferred that the composition be cooled at least to a temperature sufficient to provide suitable handling characteristics subsequent to its melt processing and annealing steps and after the shape retaining covering step, if such is applied by melt processing such as, for example, by extruding a shape retaining jacket about the composition of the invention. Obviously all compositions of the invention are cooled to ambient temperature after their annealing subsequent to having been cross-linked by radiation. The process of the invention also includes the simultaneous melt processing of compositions of the invention in conjunction with the application of a shape retaining covering thereabout such as, for example, extruding a composition of the invention into a form suitable for use as a heating cable whilst simultaneously extruding a shape retaining protective jacket thereabout. Compositions of the present invention can be satisfactorily annealed both in Steps "C" and "E" by exposure for a period of time sufficient to promote the electrical characteristics desired thereof at a temperature of the composition. After the annealing of Step "C", the composition (in the form of a completed or semi-finished heating cable as the case may be) is cross-linked by means of radiation (preferably electron radiation) in Step "D". The finished or semi-finished electrical cable, as the case may be, having the extruded and radiation cross-linked composition, as a part thereof, is annealed at a temperature at or above the melt point temperature of the composition in Step "E". Whether electrical cables of the invention enter into Steps "C", "D" and "E" as a finished product would, as described above, depend upon the particular cable and the melt point and radiation penetrability of any barrier, conductor, covering or jacket which might be placed about the outer surface of the extruded composition prior to the annealing and/or radiation steps.

Although the invention is described in detail for the purpose of illustration, it is to be understood that such detail is solely for that purpose and that variations can be made therein by those skilled in the art without departing from the spirit and scope of the invention.

I claim:

1. In a method of making an improved flexible self-temperature regulating electrical heating cable comprising at least two substantially parallel spaced-apart elongate electrical conductors electrically interconnected by means of an extruded, radiation cross-linked, electrically semi-conductive composition having a positive temperature coefficient of electrical resistance, said composition containing at least one polymeric component therein to provide sufficient crystallinity to promote the self-temperature heat regulating characteristics thereof and containing an amount of electrically conductive particles dispersed therein that is controlled within the range of 17% to 25% by weight to the total weight of the composition, the method including the steps of:

(a) Extruding the cross-linkable composition about at least two substantially parallel spaced-apart elongate electrical conductors in such a manner as to provide a form having a cross-sectional shape transverse to the longitudinal axis thereof that is suitable for use as a heating cable and having the semi-conductive composition electrically interconnecting the spaced-apart conductors;

(b) Disposing a radiation penetrable shape retaining covering in encompassing relationship about the extruded composition and conductors that has a melt temperature that is higher than the temperature chosen to anneal the composition such that the covering prevents or minimizes distortion of the composition during the annealing process;

(c) Annealing the covered cross-linkable semi-conductive composition at a temperature that is at least at the melt temperature thereof for a period of time sufficient to promote the electrical characteristics desired;

(d) Cross-linking the annealed semi-conductive composition by means of radiation; and (e) Annealing the radiation cross-linked composition at a temperature that is at least at the melt temperature thereof for a period of time sufficient to promote the electrical characteristics desired.

2. The method of claim 1 wherein the semi-conductive composition is extruded to form a generally tubular shape having an electrical conductor disposed along the central longitudinal axis thereof and having at least one radiation penetrable electrical conductor disposed about the outer surface of the composition and interconnected with the central connector by means of the semi-conductive composition.

3. The method of claim 1 wherein at least one of the electrical conductors disposed about the outer surface of the semi-conductive composition provides the shape retaining covering required to prevent or minimize distortion of the composition during the annealing process.

4. The method of claim 1 wherein the radiation is electron radiation.

5. The method of claim 1 wherein the shape retaining covering is an extruded protective jacket.

6. The method of claim 5 wherein the jacket is cross-linked during the step of radiation.

* * * * *